US011337578B2

(12) United States Patent
Huang

(10) Patent No.: US 11,337,578 B2
(45) Date of Patent: May 24, 2022

(54) SQUEEZE FLAT MOP CLEANING TOOL HAVING ADJUSTABLE SQUEEZE OPENING

(71) Applicant: CIXI BOSHENG PLASTIC CO., LTD., Zhejiang (CN)

(72) Inventor: Zhiyong Huang, Zhejiang (CN)

(73) Assignee: CIXI BOSHENG PLASTIC CO., LTD., Cixi (CN)

( * ) Notice: Subject to any disclaimer, the term of this patent is extended or adjusted under 35 U.S.C. 154(b) by 37 days.

(21) Appl. No.: 16/482,690

(22) PCT Filed: Dec. 27, 2017

(86) PCT No.: PCT/CN2017/000757
§ 371 (c)(1),
(2) Date: Jul. 31, 2019

(87) PCT Pub. No.: WO2018/201267
PCT Pub. Date: Nov. 8, 2018

(65) Prior Publication Data

US 2020/0229672 A1 Jul. 23, 2020

(30) Foreign Application Priority Data

May 2, 2017 (CN) ..... 201710302387.X

(51) Int. Cl.
*A47L 13/59* (2006.01)
*A47L 13/258* (2006.01)

(52) U.S. Cl.
CPC ..... *A47L 13/59* (2013.01); *A47L 13/258* (2013.01)

(58) Field of Classification Search
CPC .... A47L 13/58; A47L 13/59; A47L 13/13–60; A47L 13/258; A45D 40/267
(Continued)

(56) References Cited

U.S. PATENT DOCUMENTS 5,274,877 A * 1/1994 Morad ..... A47L 13/60 15/260
2007/0094834 A1* 5/2007 Gil ..... A47L 13/59 15/261

(Continued)

FOREIGN PATENT DOCUMENTS

CN 2293288 Y 10/1998
CN 201361020 Y 12/2009

(Continued)

OTHER PUBLICATIONS

Translation of DE202007011485U1 retrieved from Espaceneton Nov. 20, 2020 (Year: 2007).*

(Continued)

*Primary Examiner* — Laura C Guidotti
*Assistant Examiner* — Thomas Raymond Rodgers
(74) *Attorney, Agent, or Firm* — Young Basile Hanlon & MacFarlane, P.C.

(57) ABSTRACT

A squeeze flat mop cleaning tool having an adjustable squeeze opening is provided. The squeeze flat mop cleaning tool comprises a mop bucket and a flat mop; the flat mop comprises a mop stick and a flat mop head, and a wiper is provided on the flat mop head; the mop bucket has an independent squeezing area and an independent cleaning area, and a squeeze device is mounted on the mop bucket; the squeeze device comprises a scraper plate and a support member, and a squeeze opening is formed between the scraper plate and the support member. The scraper plate is rotatably provided on the mop bucket, and the size of the squeeze opening can be changed by the rotation of the scraper plate.

23 Claims, 20 Drawing Sheets

(58) Field of Classification Search
USPC ..... 15/111, 260, 261, 236.01
See application file for complete search history.

(56) References Cited

U.S. PATENT DOCUMENTS

| | | | | |
|---|---|---|---|---|
| 2016/0113471 | A1 | 4/2016 | Zhu | |
| 2016/0193728 | A1* | 7/2016 | Li | A47L 13/59 15/118 |

FOREIGN PATENT DOCUMENTS

| | | | | |
|---|---|---|---|---|
| CN | 101987007 | A | 3/2011 | |
| CN | 102846282 | A | 1/2013 | |
| CN | 104013365 | A | 9/2014 | |
| CN | 203953588 | U | 11/2014 | |
| CN | 104337477 | A | 2/2015 | |
| CN | 205054066 | U | 3/2016 | |
| CN | 105816127 | A | 8/2016 | |
| CN | 205493747 | U | 8/2016 | |
| CN | 205758467 | U | 12/2016 | |
| CN | 206080445 | U | 4/2017 | |
| CN | 206080446 | U | 4/2017 | |
| CN | 206080447 | U | 4/2017 | |
| CN | 106983465 | A | 7/2017 | |
| DE | 9416565 | U1 * | 12/1994 | A47L 13/59 |
| DE | 20008677 | U1 | 8/2000 | |
| DE | 202007011485 | U1 * | 10/2007 | A47L 13/58 |
| WO | 2006015758 | A2 | 2/2006 | |

OTHER PUBLICATIONS

Translation of DE9416565U1, retrieved from Espacenet on Mar. 15, 2021 (Year: 1994).*

Extended European Search Report for European Application No. 17908296.1 dated Dec. 22, 2020.

Chinese First Office Action with English Translation for Chinese Application No. 201710302387.X; dated Apr. 29, 2020; pp. 1-10.

Chinese First Search Report for Chinese Application No. 201710302387X; dated Apr. 23, 2020; pp. 1-2.

Chinese Second Office Action with English Translation for Chinese Application No. 201710302387-X; dated Mar. 19, 2021; pp. 1-8.

* cited by examiner

SQUEEZE FLAT MOP CLEANING TOOL HAVING ADJUSTABLE SQUEEZE OPENING

CROSS-REFERENCE TO RELATED APPLICATION(S)

This application is a 371 application of International Application No. PCT/CN2017/000757, filed on Dec. 27, 2017, which claims priority to Chinese Patent Application No. 201710302387.X, filed on May 2, 2017, the entire disclosure of both of which are hereby incorporated by reference.

TECHNICAL FIELD

The invention relates to the technical field of cleaning tools, in particular to a squeeze flat mop cleaning tool having an adjustable squeeze opening.

BACKGROUND

A general structure of a squeeze flat mop cleaning tool is as follows: the squeeze flat mop cleaning tool comprises a mop bucket and a flat mop, wherein the flat mop comprises a mop stick and a flat mop plate movably connected to the mop stick, and a wiper is arranged on the flat mop plate; the mop bucket is provided with squeeze opening squeezing devices, during cleaning and squeezing, the flat mop plate is rotated to a state suitable for cleaning and squeezing, and the flat mop plate is relatively moved and squeezed between the squeeze opening squeezing devices to be squeezed, so as to move, squeeze and clean the wiper.

There are two types of squeeze flat mop cleaning tools, one is a single-bucket squeeze flat mop cleaning tool and the other is a double-barrel squeeze flat mop cleaning tool. The single-bucket squeeze flat mop cleaning tool only has one mop bucket, which is provided with a squeeze opening squeezing device; and the double-bucket squeeze flat mop cleaning tool is characterized in that a mop bucket is provided with a cleaning area and a squeezing area which are not communicated with each other, and squeeze opening squeezing devices are arranged in both the cleaning area and the squeezing area.

In order to achieve a good mopping effect and improve mopping efficiency, it is usually desirable to have a long flat mop plate; however, in existing squeeze flat mop cleaning tools, the flat mop plate adopts a hard plate body as a whole, and when the flat mop plate is inserted into the squeeze opening squeezing device for squeezing during squeezing and cleaning, if the flat mop plate is long, the height of the mop bucket is high correspondingly, thus causing the problem that the mop bucket is huge, making packaging and transportation inconvenient.

In order to overcome the above technical problem, Chinese patent CN206080446U (patent No. 201620870001.6) discloses a squeeze flat mop cleaning tool, a mop bucket thereof is provided with a cleaning area and a squeezing area, and a push opening squeezing device is arranged on the mop bucket. After rotating to a squeezing or cleaning state, a mop head of a flat mop moves up and down in the push opening squeezing device, a squeezing effect is generated between a wiper on the flat mop head and the push opening squeezing device to squeeze or clean the wiper, and water squeezed out can flow to the cleaning area through a water way.

The above patent has the disadvantage that the installation mode of a squeezer in the push opening squeezing device cannot realize the change of the size of a squeeze opening, so the mop bucket may be lifted due to the friction between the squeezer and the wiper when the flat mop is lifted upwards, and a stable and proper squeezing force cannot be obtained when the flat mop is pressed downwards.

BRIEF SUMMARY OF THE INVENTION

In order to overcome the above-mentioned defect of existing squeeze flat mop cleaning tools, the invention provides a squeeze flat mop cleaning tool having an adjustable squeeze opening.

The technical scheme for solving the technical problem is as follows: the squeeze flat mop cleaning tool having the adjustable squeeze opening comprises a mop bucket and a flat mop, wherein the flat mop comprises a mop stick and a flat mop head movably connected to the mop stick, and a wiper is provided on the flat mop head;

- the mop bucket has an independent squeezing area and an independent cleaning area, a squeeze device is mounted on the mop bucket, and during cleaning and squeezing, the flat mop head is rotated to a state suitable for cleaning and squeezing;
- the squeeze device comprises a scraper plate used for squeezing the wiper on the flat mop head, and a support member opposite the scraper plate, and a squeeze opening is formed between the scraper plate and the support member;
- during squeezing, the flat mop plate is inserted into the squeeze opening in the squeezing area, and the wiper and the scraper plate are moved and squeezed relative to each other so that the wiper is squeezed; during cleaning, the flat mop plate is inserted into the squeeze opening in the cleaning area, and the wiper and the scraper plate are moved and squeezed relative to each other so that the wiper is cleaned; and
- the scraper plate is rotatably provided on the mop bucket, and the size of the squeeze opening can be changed by the rotation of the scraper plate; when the flat mop head is pressed downwards, the scraper plate is positioned in a narrow position relative to the support member, thereby reducing the squeeze opening; and when the flat mop head is pulled upwards, the wiper drives the scraper plate to rotate upwards, thereby enlarging the squeeze opening.

Preferably, the support member is another scraper plate or other support members.

Further, the scraper plate is directly installed on the mop bucket. Alternatively, the scraper plate is installed on a squeezing frame, and the squeezing frame is installed on the mop bucket.

Further, when the flat mop head is pressed down, the wiper drives the scraper plate to rotate downwards, so that the scraper plate is in a narrow position and the squeeze opening is relatively small. Alternatively, the squeeze flat mop cleaning tool having the adjustable squeeze opening further comprises an elastic device which acts on the scraper plate to place the scraper plate in a narrow position so as to make the squeeze opening relatively small.

Further, the scraper plate is directly rotatably connected to the mop bucket or the squeezing frame.

Further, both ends of the scraper plate are provided with rotating pins, and the two rotating pins are inserted into the squeezing frame or the mop bucket; alternatively, the squeezing frame or the mop bucket is provided with convex shafts, and the convex shafts are inserted into two ends of the scraper plate respectively.

Alternatively, the squeezing frame or the mop bucket is provided with a pivoting base, and a side edge of the scraper plate is pivoted to the pivoting base.

Alternatively, the squeezing frame or the mop bucket is provided with a clamping base, the clamping base is provided with a clamping opening, the scraper plate is provided with a clamped shaft, and the clamped shaft rotates after being clamped in the clamping opening of the clamping base.

Further, the squeezing frame or the mop bucket is provided with a limiting device for limiting the scraper plate to a narrow position.

Further, the limiting devices are limiting bases, the limiting bases are provided with limiting notches, the scraper plate is positioned in the limiting notches, and the scraper plate reaches the narrow position when touching one side of the limiting bases.

Alternatively, the limiting devices are two limiting grooves formed in the squeezing frame or the mop bucket, two ends of the scraper plate are inserted into the limiting grooves, and the scraper plate reaches the narrow position when touching one side of the limiting grooves.

Alternatively, the squeezing frame or the mop bucket is provided with a blocking part for blocking the scraper plate, and the scraper plate reaches the narrow position when touching the blocking part.

Alternatively, the squeezing frame or the mop bucket is provided with inclined grooves corresponding to the two ends of the scraper plate, the two ends of the scraper plate are inserted into the inclined grooves, a space along the thickness direction of the scraper plate is arranged between the scraper plate and the inclined grooves, and the width of the squeeze opening can be adjusted in the moving process of the scraper plate; alternatively, the two ends of the scraper plate are provided with inclined grooves, the squeezing frame or the mop bucket is provided with insert plates corresponding to the two inclined grooves, the insert plates are inserted into the inclined grooves, a space along the thickness direction of the scraper plate is arranged between the insert plates and the inclined grooves, and the width of the squeeze opening can be adjusted in the moving process of the scraper plate.

Further, the limiting device can also limit the scraper plate to a maximum squeeze opening position when the squeeze opening is enlarged.

Further, convex bosses are arranged at the bottom of the mop bucket in the squeezing area and the cleaning area, and the bosses extend away from the scraper plate and an extending length at least exceeds the opening.

Compared with the prior art, the invention has the beneficial effects that the rotation of the scraper plate can change the size of the squeeze opening; in actual use, the scraper plate is positioned in a narrow position relative to the support member when the flat mop head is pressed downwards, so that the squeeze opening is small, making the scraper plate generate a large and appropriate squeezing force and friction force on the wiper when the flat mop head is pressed downwards, so the water yield of the wiper squeezing operation is high and the best squeezing effect can be achieved; meanwhile, due to the large friction force of the scraper plate on the wiper, the best wiper cleaning effect can be achieved; and then the flat mop head is pulled upwards, the wiper drives the scraper plate to rotate upwards, so that the squeeze opening is enlarged and the squeezing force exerted by the scraper plate on the wiper is reduced, making the operation of pulling up the flat mop head easier and avoiding the situation where the mop bucket is lifted when the flat mop is lifted up, and the use experience is very comfortable.

DETAILED DESCRIPTION OF THE INVENTION

Figure 1:
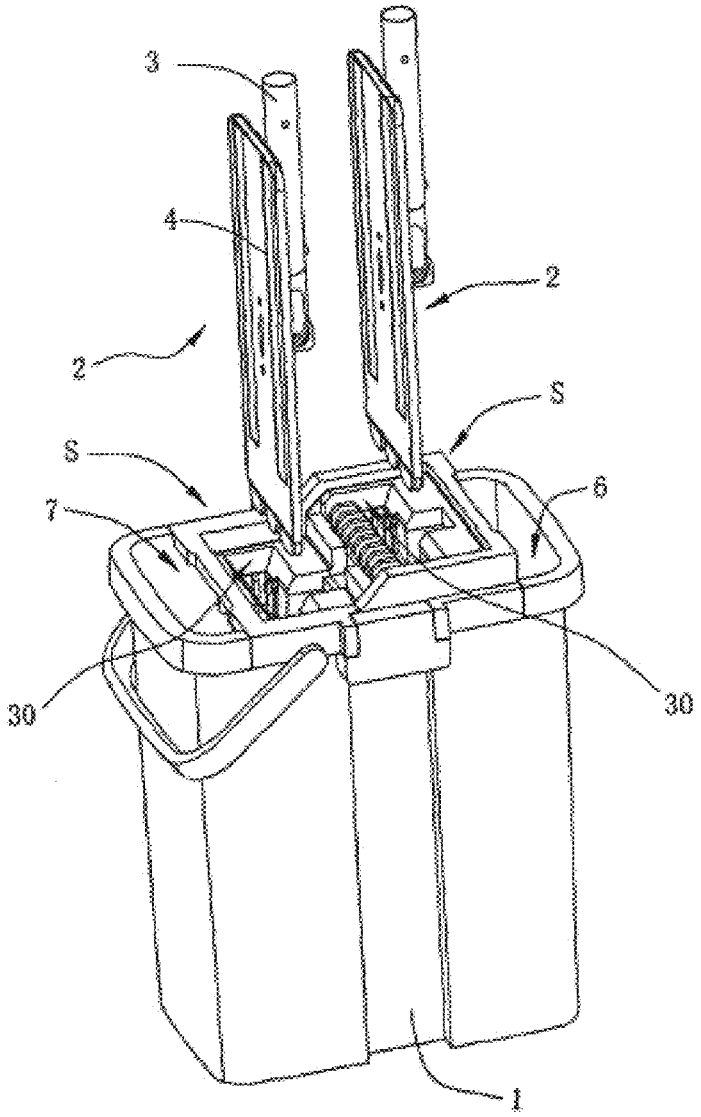
FIG. 1 is a structural diagram of an embodiment of the present invention.
Figure 2:
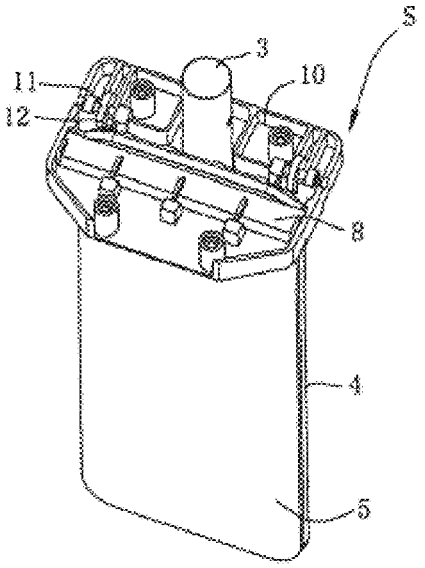
FIG. 2 is a structural diagram showing a flat mop head being inserted into a squeeze opening of a squeeze device and pressed downwards in an embodiment of the present invention.
Figure 3:
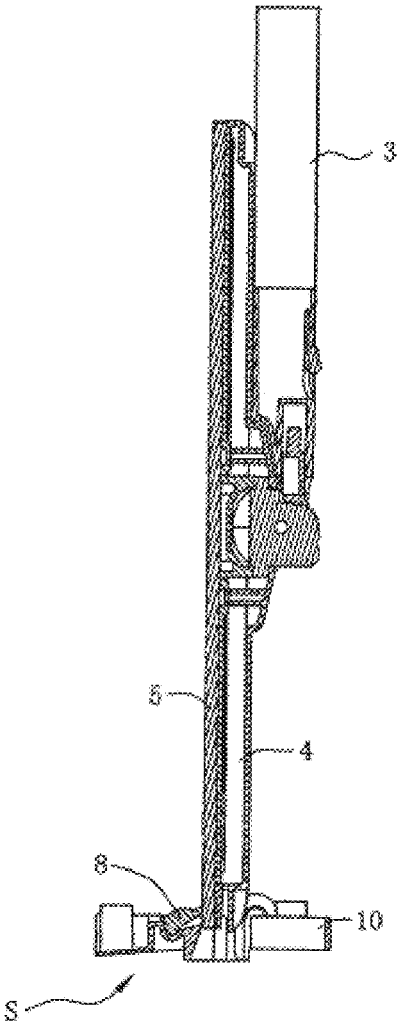
FIG. 3 is a sectional view of FIG. 2.
Figure 4:
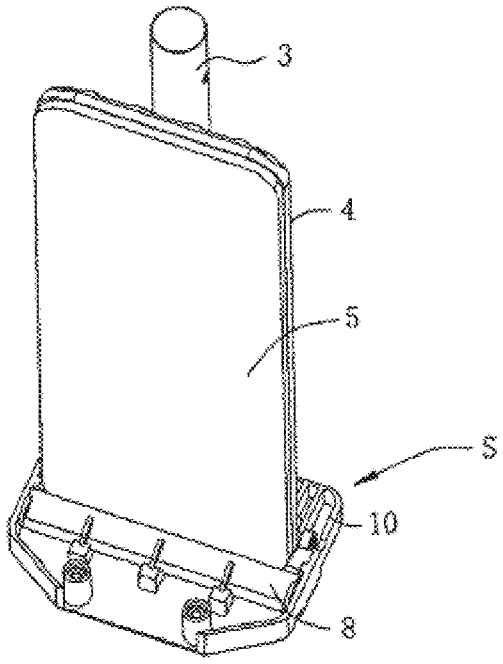
FIG. 4 is a structural diagram showing a flat mop head being lifted upwards in an embodiment of the present invention.
Figure 5:
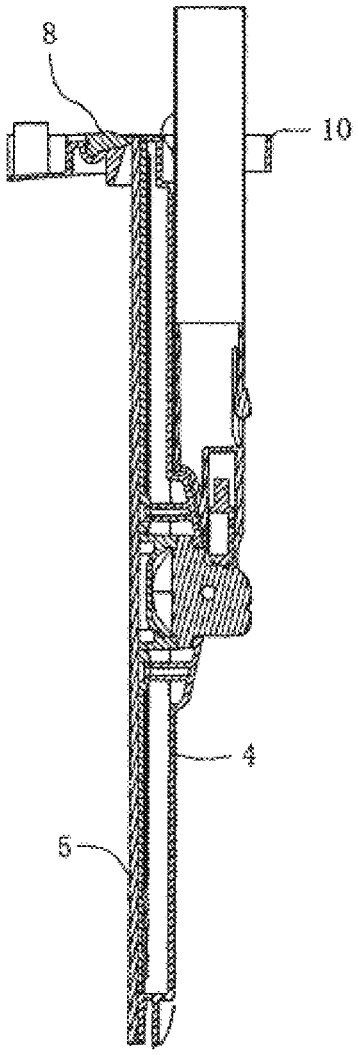
FIG. 5 is a sectional view of FIG. 4.

The present invention will now be further explained with reference to the drawings and specific embodiments.

As shown in FIG. 1-FIG. 5, a preferred embodiment of a squeeze flat mop cleaning tool having an adjustable squeeze opening in the present invention is provided. The squeeze flat mop cleaning tool comprises a mop bucket 1, a flat mop 2, and two squeeze devices S arranged on the mop bucket.

The flat mop 2 comprises a mop stick 3 and a flat mop head 4 movably connected to the mop stick 3, a wiper 5 is arranged on the flat mop head 4, the wiper 5 is used for wiping and cleaning objects and can be made of various existing materials, such as towels, flannelette and other fabrics, the wiper 5 is generally in a sheet shape and is attached to one surface of the flat mop head 4 to form a single-sided flat mop, or two surfaces of the flat mop head 4 are each provided with a wiper 5 to form a double-sided flat mop, all of which belong to the prior art and are not described in detail here.

The mop bucket 1 has an independent squeezing area 6 and an independent cleaning area 7. The independent squeezing area 6 and the independent cleaning area 7 refer to that the mop bucket 1 has two volumetric bodies which are not communicated with each other, wherein one volumetric body serves as the squeezing area 6 and the other serves as the cleaning area 7. In this embodiment, the two squeeze devices S are arranged at the top of the squeezing area 6 and the top of the cleaning area 7 respectively. When cleaning the wiper 5 or squeezing the wiper 5, the flat mop head 4 can be rotated to a state close to one side of the mop stick 3. As shown in FIG. 1 to FIG. 5, the flat mop head 4 and the wiper 5 can be inserted into the squeeze devices S and moved up and down relative to the squeeze devices S so as to achieve cleaning or squeezing. During operation, more water is generally required in the cleaning area 7, while the squeezing area 6 is in a substantially water-free state, or there is only a small amount of water, so as to prevent water from being sucked back into the wiper 5 during squeezing.

The squeeze device S comprises a scraper plate 8 for squeezing the wiper 5 on the flat mop head 4, and a support member opposite the scraper plate 8, and a squeeze opening 9 for inserting the flat mop head 4 and the wiper 5 is formed between the scraper plate 8 and the support member.

The support member is another scraper plate or other support member. The support member being another scraper plate is suitable for the case of a double-sided flat mop, i.e. both sides of the flat mop head 4 are provided with wipers 5, and the support member being another support member is suitable for a single-sided flat mop, i.e. one side of the flat mop head 4 is provided with a wiper.

During squeezing, the flat mop head 4 and the wiper 5 are inserted into the squeeze opening 9 of the squeeze device S located in the squeezing area 6, and the wiper 5 and the scraper plate 8 are moved and squeezed relative to each other so as to squeeze the wiper 5. During cleaning, the flat mop head 4 and the wiper 5 are inserted into the squeeze opening 9 of the squeeze device S located in the cleaning area 7, and the wiper 5 and the scraper plate 9 are moved and squeezed relative to each other so as to clean the wiper 5.

The scraper plate 8 can rotate relative to the mop bucket 1, and the rotation of the scraper plate 8 can change the size of the squeeze opening 9; specifically, when the flat mop head 4 is pressed downwards (the flat mop head 4 moves downwards relative to the squeeze device S), the scraper plate 8 rotates downwards, and the scraper plate 8 is positioned in a narrow position relative to the support member, so that the squeeze opening 9 is relatively small, and when the flat mop head 4 is pulled up (the flat mop head 4 moves upwards relative to the squeeze device S), the wiper 5 drives the scraper plate 8 to rotate upwards, so that the squeeze opening 9 is enlarged.

Figure 32:
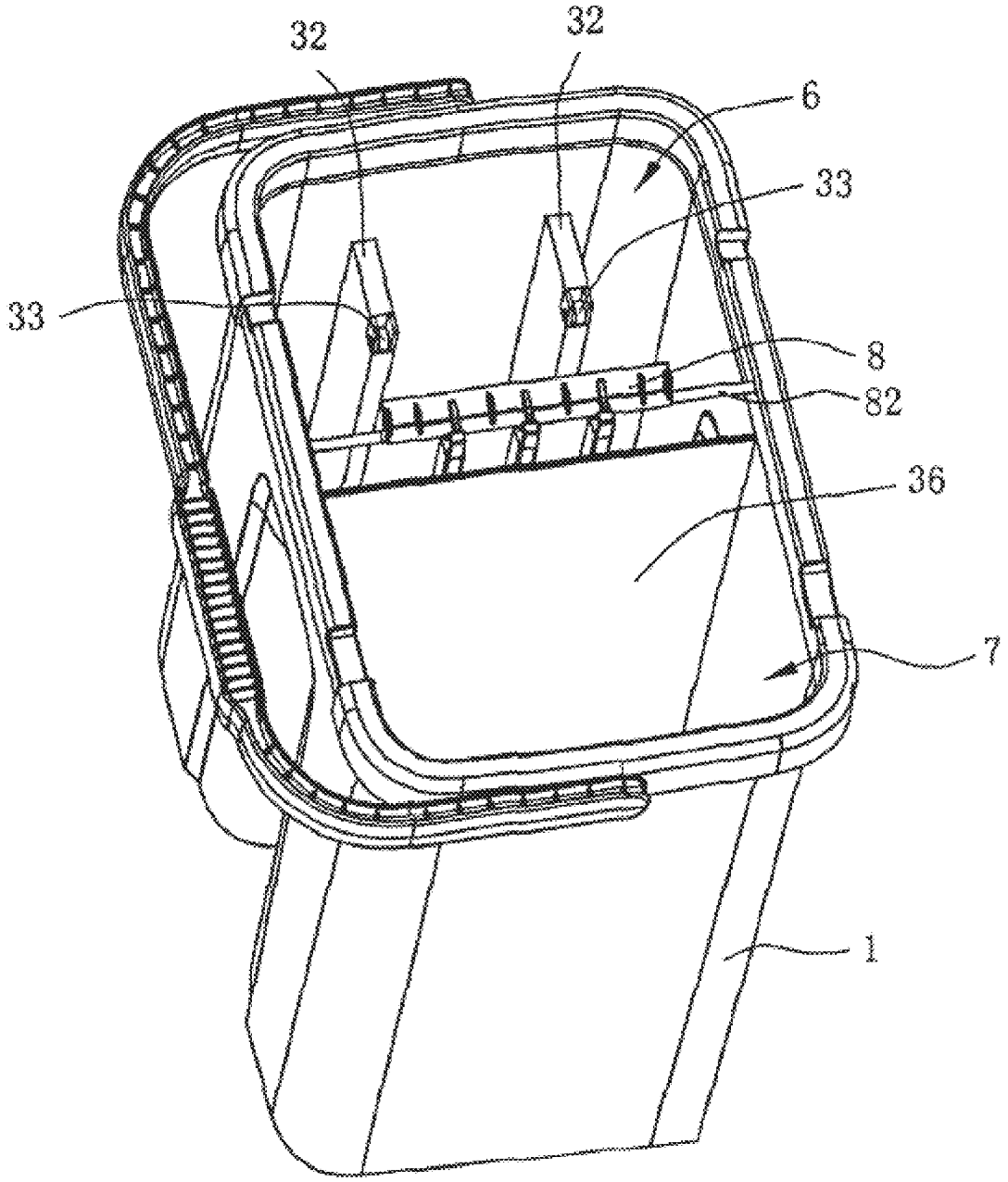
FIG. 32 is a structural diagram showing a thirteenth squeeze device of the present invention being installed on a mop bucket.

The scraper plate 8 can be directly installed on the mop bucket 1 (the thirteenth squeeze device shown in FIG. 32). The scraper plate 8 can also be installed on a squeezing frame 10 first, and the squeezing frame 10 is then installed on the mop bucket 1.

Figure 25:
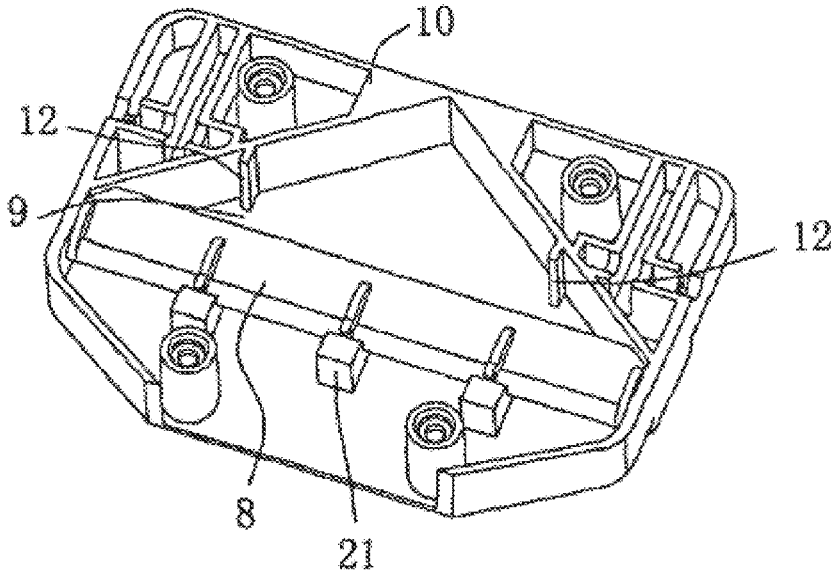
FIG. 25 is a structural diagram in which an opening in a squeeze device of the present invention is in another shape.
Figure 26:
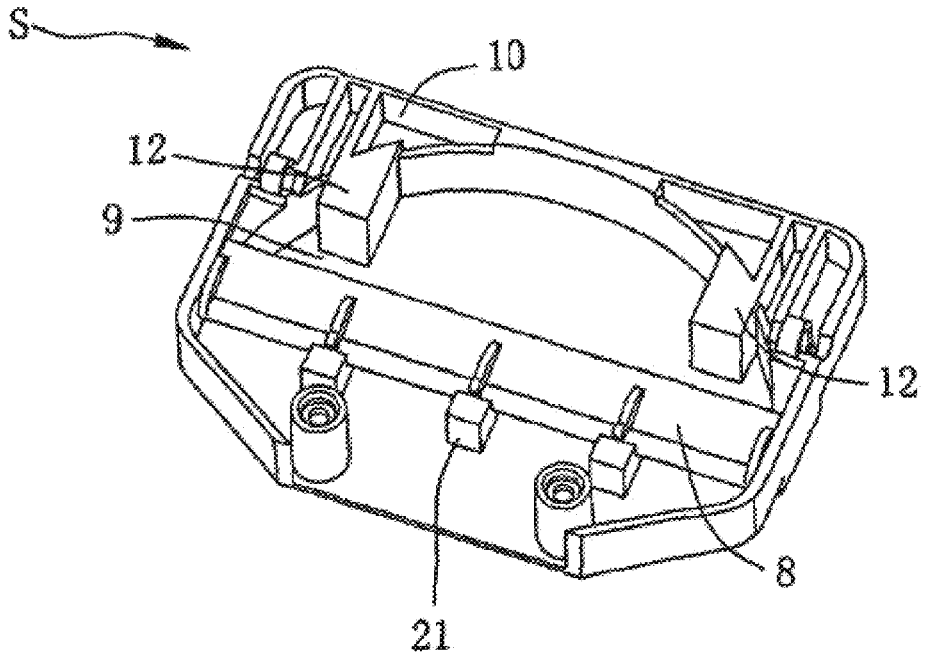
FIG. 26 is a structural diagram in which an opening in a squeeze device of the present invention is in yet another shape.

The embodiment of the present invention will be further described with the example that the scraper plate 8 is installed on the squeezing frame 10. The squeezing frame 10 has an opening, the scraper plate 8 is rotatably mounted on the squeezing frame 10, and a side, opposite the scraper plate 8, in the opening is provided with a support member; a side edge of the scraper plate 8 is exposed in the opening so as to scrape the wiper 5 inserted therein, and a squeeze opening 9 is formed between the scraper plate 8 and the support member; at this point, the flat mop is a single-sided flat mop, i.e., one side of the flat mop head is provided with a wiper, and when the flat mop head 4 rotates to a cleaning and squeezing state, the flat mop head 4 is positioned on one side of the mop stick 3; or another scraper plate is arranged on the other side, opposite the scraper plate 8, of the opening, a squeeze opening 9 is formed between the scraper plates, and at this point, the flat mop is a double-sided flat mop, i.e. wipes are arranged on both sides of the flat mop head. The shape of the opening of the squeezing frame 10 is not limited, and may be an elongated strip-shaped hole as shown in FIG. 1-FIG. 24, a triangle as shown in FIG. 25, or a semicircular shape as shown in FIG. 26.

The support member of the present invention can take the following forms: in the simplest way, the support member is directly formed by a side wall of a side, opposite the scraper plate 8, in the opening of the squeezing frame 10 (i.e. the first support member is a smooth plane).

Here, three preferred support members are described in detail. A first support member is shown in FIG. 22, in which a pair of wheels 11 are arranged on the side, opposite the scraper plate 8, in the opening of the squeezing frame 10, and the first support member is adopted in seven different squeeze devices S as shown in FIG. 8-FIG. 21.

Figure 23:
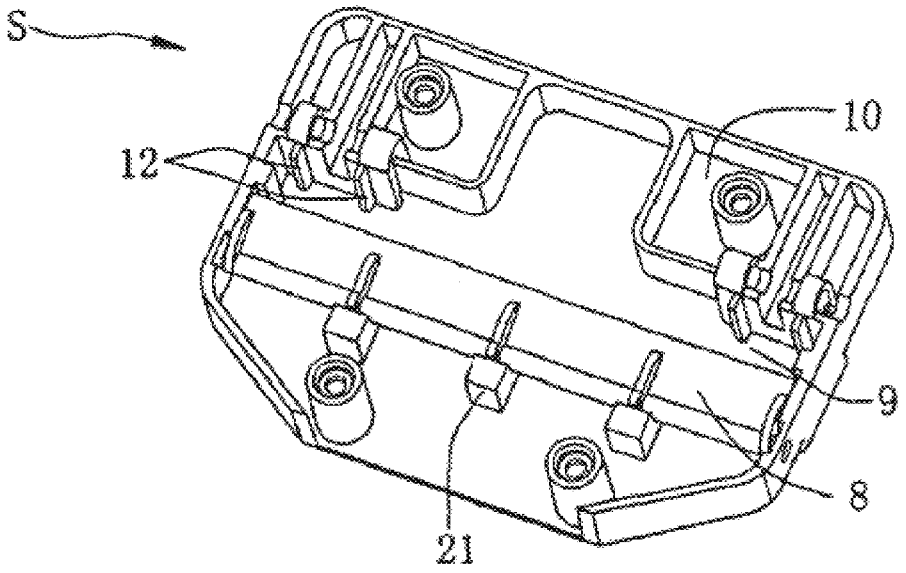
FIG. 23 is a structural diagram of a second support member of the present invention.

A second support member is shown in FIG. 23, in which a plurality of supporting guide ribs 12 are arranged on the side, opposite the scraper plate 8, in the opening of the squeezing frame 10; of course, it can also be a combination of wheels 11 and supporting guide ribs 12.

Figure 24:
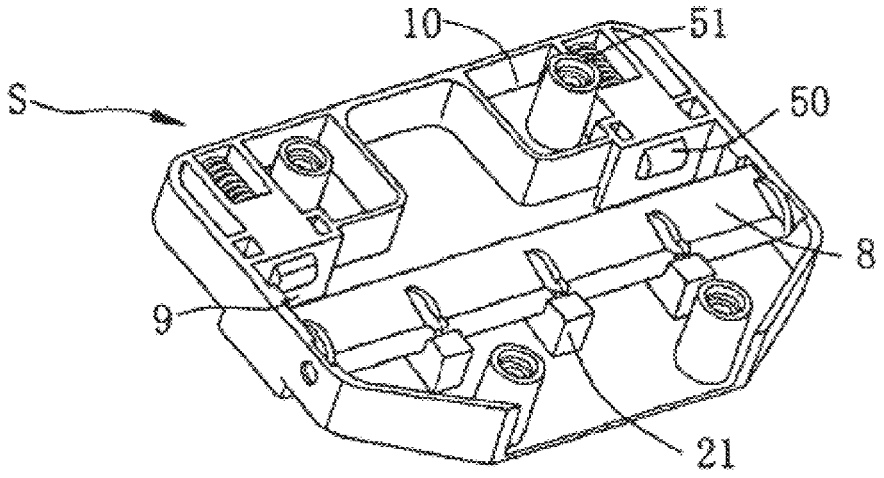
FIG. 24 is a structural diagram of a third support member of the present invention.

A third support member is shown in FIG. 24, in which a pair of elastic blocks 50 are arranged on the side, opposite the scraper plate 8, in the opening of the squeezing frame 10, and springs 51 are arranged between tail ends of the elastic blocks 50 and the squeezing frame 10 so as to abut against the elastic blocks 50 and expose the same to the squeeze opening 9.

During cleaning and squeezing, the support member is propped against a side of the flat mop head 4 where no wiper is provided. The support member guides and supports the flat mop head 4 to prevent the same from turning over during the up-and-down movement. It should be noted that during the up-and-down movement of the flat mop head 4, the support member does not necessarily contact the flat mop head in the whole process. A preferred structure is that the supporting guide ribs 12 extend to a lower part of the opening, then the supporting guide ribs 12 have a larger length, so even if the flat mop head 4 is inserted deeply, the supporting guide ribs 12 can block and limit the flat mop head 4 to prevent the same from separating from the squeeze device. As a preferable structural form, a lower end of each supporting guide rib 12 is provided with an arc-shaped surface or an inclined surface through which the flat mop head 4 can be guided to come back upwards when the flat mop head is inserted deeply.

In this embodiment, the top of the mop bucket corresponding to the squeezing area is provided with a squeeze device, and the mop bucket corresponding to the cleaning area is provided with a squeeze device. Of course, the mop bucket can also be provided with only one squeeze device S, in this case, the squeeze device is in the squeezing area during squeezing and in the cleaning area during cleaning, and specifically, the squeeze device is slidably or turnably arranged on the mop bucket, thus realizing the position conversion of the squeeze device between the squeezing area and the cleaning area.

During squeezing of the flat mop, the flat mop head 4 is rotated to a state suitable for squeezing (the state is usually manifested as: the flat mop head is parallel or substantially parallel to the mop stick after being rotated), then the flat mop is inserted into the squeeze opening 9 to be moved up and down, and the wiper 5 on the flat mop head and the scraper plate 8 are moved and squeezed relative to each other to achieve squeezing.

When the flat mop is cleaned, water is filled in the cleaning area, and the flat mop head 4 is rotated to a state suitable for cleaning (the state is usually manifested as: the flat mop head is parallel or substantially parallel to the mop stick after being rotated), then the flat mop is inserted into the squeeze opening 9 to be moved up and down, and the wiper 5 on the flat mop head 4 and the scraper plate 8 of the squeeze device S are moved and squeezed relative to each other for squeezing and scraping, so as to achieve cleaning.

FIG. 8-FIG. 21 show seven different squeeze devices S, which differ in a connection structure and a limiting device between the scraper plate 8 and the squeezing frame 10. Details are as follows.

The scraper plate 8 can be directly rotatably connected to the squeezing frame 10. Specifically, in a first squeeze device shown in FIG. 8 and FIG. 9 and a fifth squeeze device shown in FIG. 16 and FIG. 17, two ends of the scraper plate 8 are rotatably connected to the squeezing frame 10, the two ends of the scraper plate 8 are provided with rotating pins 13 respectively, and the two rotating pins 13 are inserted into shaft holes 14 in the squeezing frame 10 respectively. Alternatively, in a second squeeze device shown in FIG. 10 and FIG. 11 and a sixth squeeze device shown in FIG. 18 and FIG. 19, the squeezing frame 10 is provided with convex shafts 15, the two ends of the scraper plate are provided with insertion holes 16, and the convex shafts 15 are inserted into the insertion holes 16 at the two ends of the scraper plate respectively.

Figure 12:
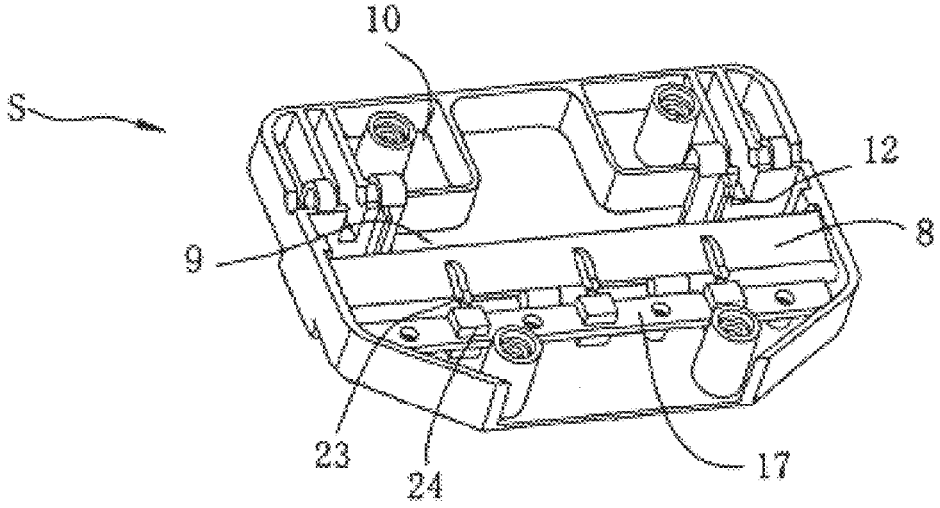
FIG. 12 is a structural diagram of a third squeeze device of the present invention.
Figure 13:
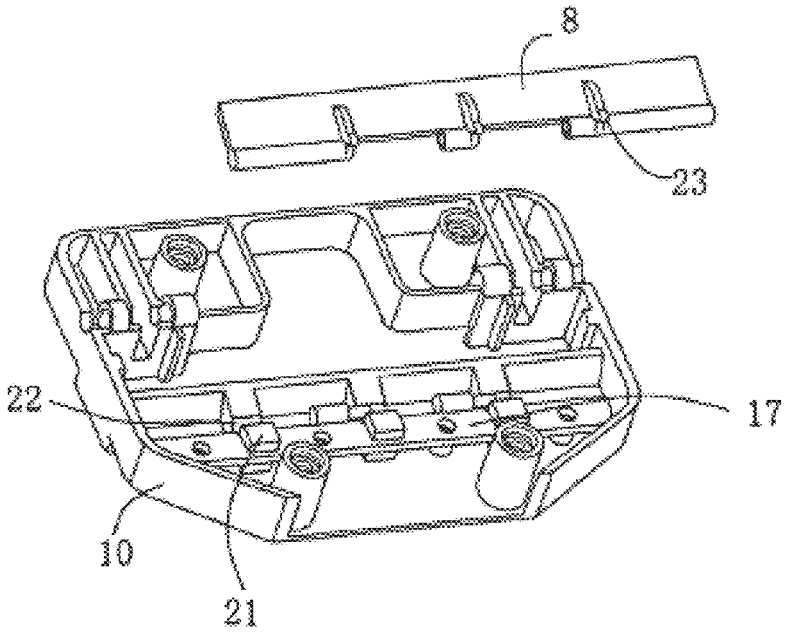
FIG. 13 is an exploded view of FIG. 12.
Figure 14:
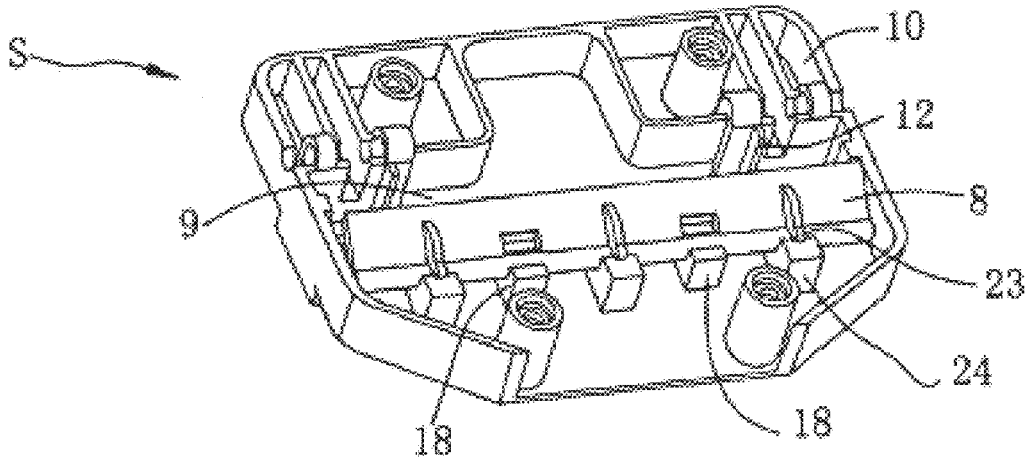
FIG. 14 is a structural diagram of a fourth squeeze device of the present invention.
Figure 15:
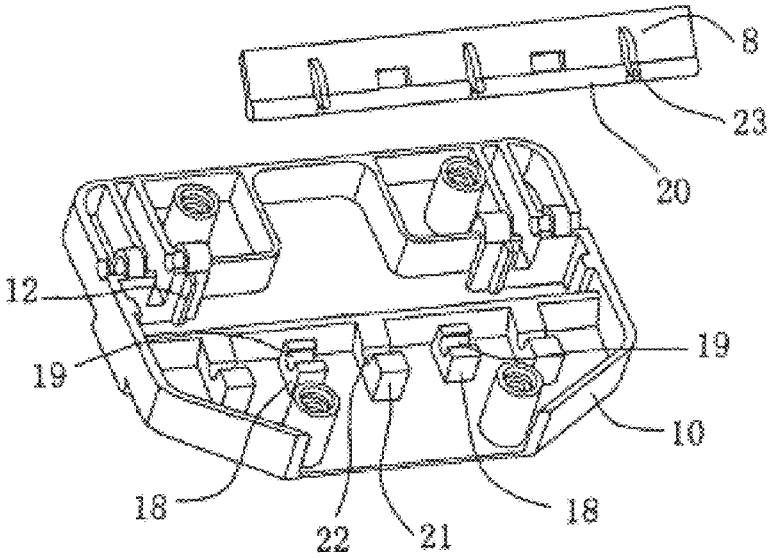
FIG. 15 is an exploded view of FIG. 14.
Figure 16:
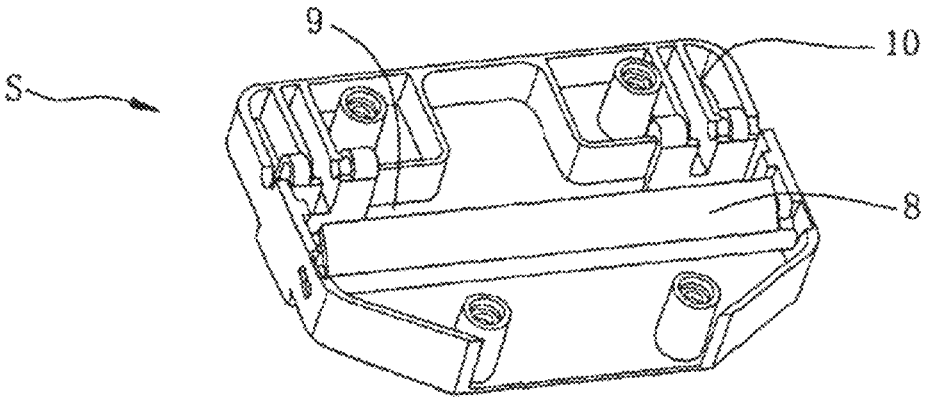
FIG. 16 is a structural diagram of a fifth squeeze device of the present invention.

Of course, the scraper plate 8 and the squeezing frame 10 can also be connected by other structures, as long as the movable connection between the scraper plate 8 and the squeezing frame 10 is achieved so that the scraper plate can rotate, and the scraper plate 8 can adjust the width of the squeeze opening 9 in the rotating process. The following is a list of specific connection structures to achieve the above effect:

(1) in a third squeeze device shown in FIG. 12 and FIG. 13, the squeezing frame 10 is provided with a pivoting base 17, and a side edge of the scraper plate 8 is pivoted to the pivoting base 17; and (2) in a fourth squeeze device shown in FIG. 14 and FIG. 15, the squeezing frame 10 is provided with a clamping base 18, the clamping base is provided with a clamping opening 19, the scraper plate 8 is provided with a clamped shaft 20, and the clamped shaft 20 rotates after being clamped into the clamping opening 19 of the clamping base.

The scraper plate 8 can be limited to a narrow position during rotation by the following method: the squeezing frame 10 is provided with a limiting device which can limit the scraper plate 8 to the narrow position, the specific narrow position is determined by the limiting device, and the limiting device can also limit the scraper plate 8 to a maximum squeeze opening position when the squeeze opening is enlarged. In four squeeze devices shown in FIG. 8, FIG. 9, FIG. 10, FIG. 11, FIG. 12, FIG. 13, FIG. 14 and FIG. 15, the limiting device is a row of limiting bases 21 arranged on the squeezing frame 10, the limiting bases can be directly arranged on the squeezing frame 21 or can be arranged on the pivoting base 17, the limiting bases 21 are provided with limiting notches 22, the scraper plate 8 is positioned in the limiting notches 22, and the scraper plate 8 reaches the narrow position when touching one side of the limiting bases 21, and reaches the maximum squeeze opening position when touching the other sides of the limiting bases 21. The scraper plate 8 can also be provided with lugs 23 to assist in limiting, and the maximum squeeze opening position can be reached through the contact of the lugs 23 and the limiting bases.

Figure 17:
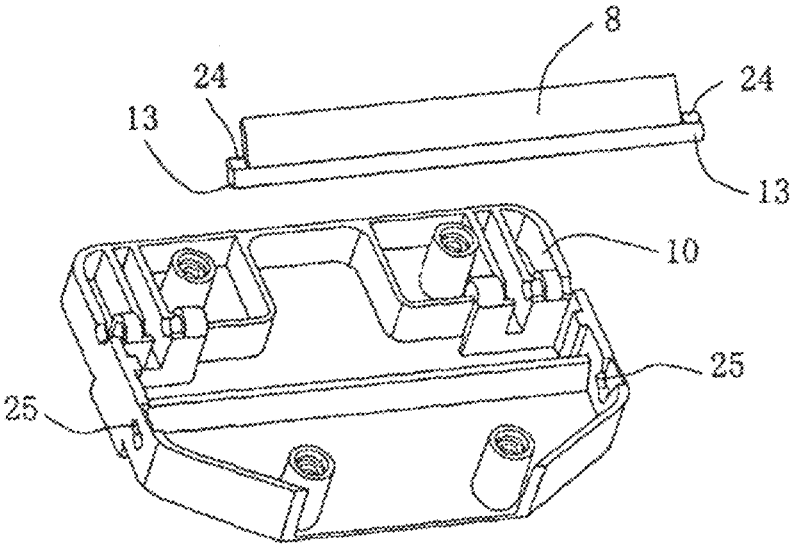
FIG. 17 is an exploded view of FIG. 16.
Figure 18:
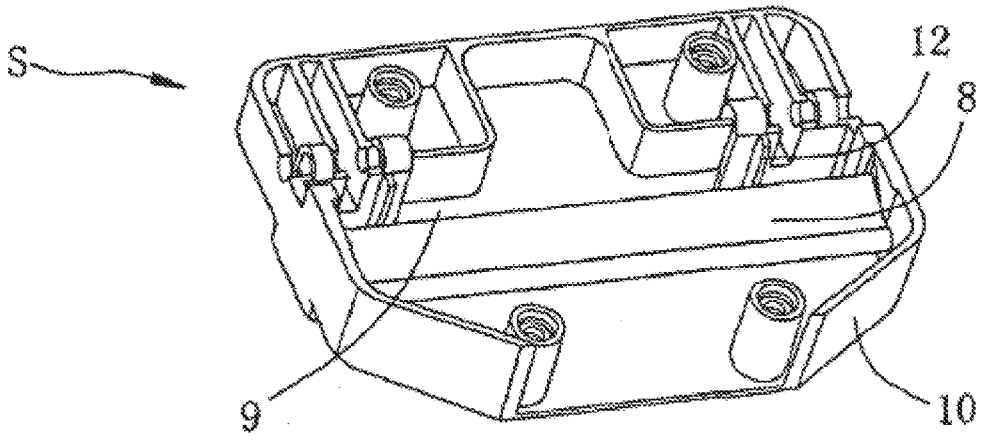
FIG. 18 is a structural diagram of a sixth squeeze device of the present invention.
Figure 19:
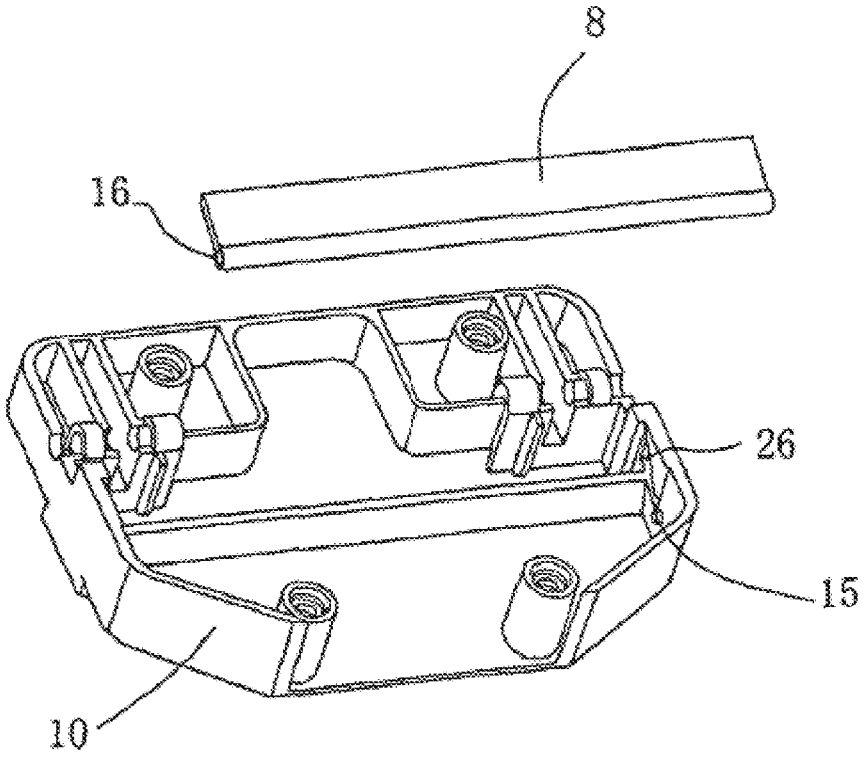
FIG. 19 is an exploded view of FIG. 18.

Of course, the limiting device can also adopt other structural forms, such as a fifth squeeze device shown in FIG. 17, in which the two ends of the scraper plate 8 are provided with outward protruding limiting blocks 24, the squeezing frame 10 is provided with limiting openings 25, the limiting blocks 24 are inserted into the limiting openings 25, the limiting blocks 24 move in the limiting openings 25, and the scraper plate 8 reaches the narrow position when touching one side of the limiting openings 25, and reaches the maximum squeeze opening position when touching the other sides of the limiting openings 25. Also in a sixth squeeze device shown in FIG. 19, the limiting device is limiting grooves 26 arranged on the squeezing frame 10, the two ends of the scraper plate 8 are inserted into the limiting grooves 26 respectively, and the scraper plate 8 reaches the narrow position when touching one side of the limiting grooves 26, and reaches the maximum squeeze opening position when touching the other sides of the limiting grooves 26. The limiting device may also be provided with two blocking parts for blocking the scraper plate 8 on the squeezing frame 10, the blocking parts form the limiting device, and the scraper plate reaches the narrow position when touching one blocking part and reaches the maximum squeeze opening position when touching the other blocking part.

When the flat mop head 4 is inserted into the squeeze opening 9 and moves downwards relative to the squeeze device S, the wiper 5 makes contact with the scraper plate 8, the wiper 5 drives the scraper plate 8 to rotate downwards under the action of the friction force, so that the squeeze opening 9 is narrowed and reaches the narrow position, the squeeze opening 9 is kept small, and therefore the wiper 5 can be squeezed thoroughly. When the flat mop head 4 moves upwards, the wiper 5 makes contact with the scraper plate 8, and the scraper plate 8 rotates upwards under the action of the friction force, so that the squeeze opening 9 is widened and reaches the maximum squeeze opening position, the squeeze opening 9 is kept large, the friction force between the scraper plate 8 and the wiper 5 is reduced, so that the abrasion of the wiper 5 is reduced, and meanwhile, the mop bucket 1 can be prevented from being lifted up when the flat plate mop 2 is lifted upwards.

Figure 20:
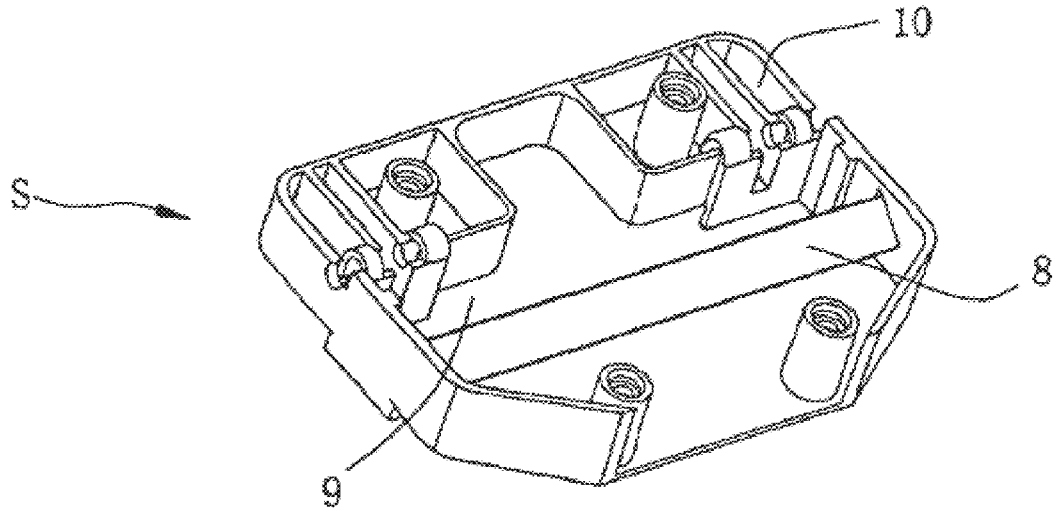
FIG. 20 is a structural diagram of a seventh squeeze device of the present invention.
Figure 21:
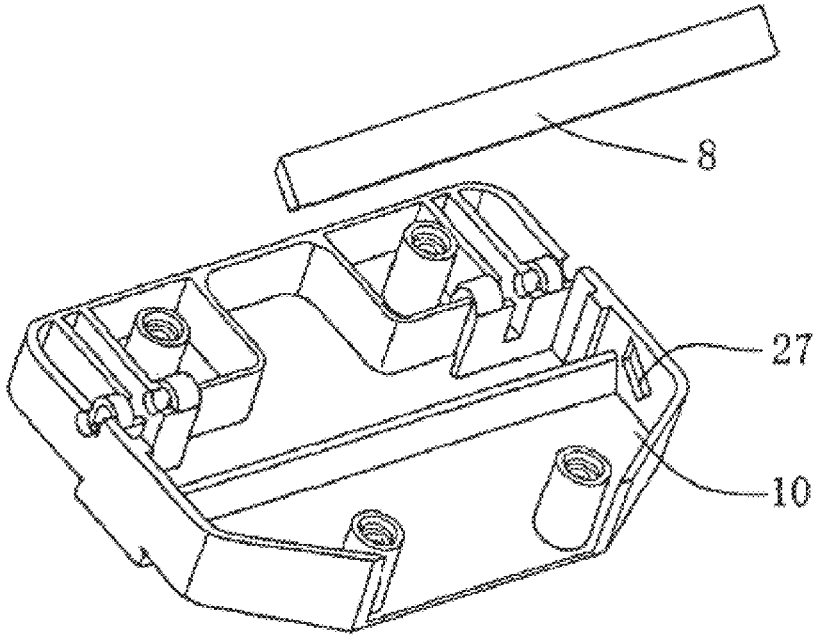
FIG. 21 is an exploded view of FIG. 20.
Figure 22:
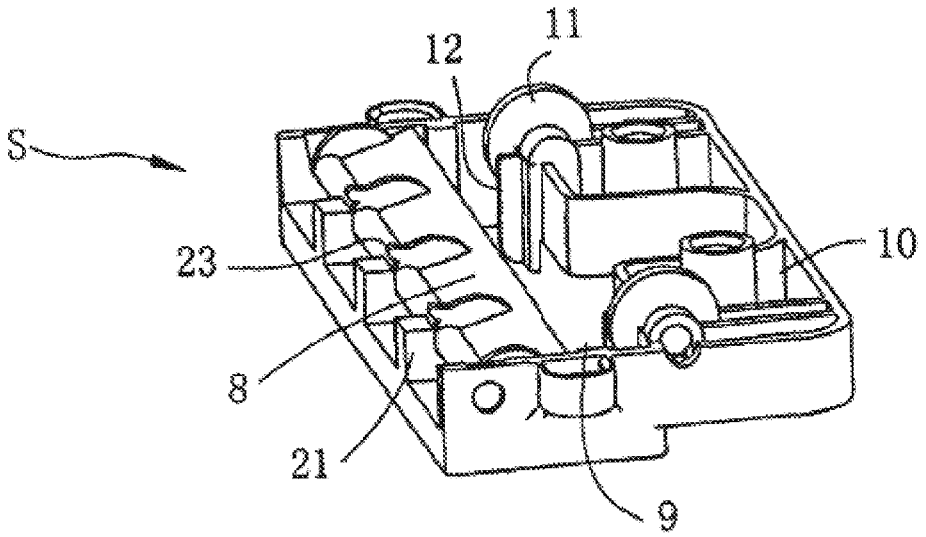
FIG. 22 is a structural diagram of a first support member of the present invention.

In a seventh squeeze device shown in FIG. 20 and FIG. 21, a movable connection structure between the scraper plate 8 and the squeezing frame 10 naturally comprises a limiting device; specifically, the squeezing frame 10 is provided with inclined grooves 27 corresponding to the two ends of the scraper plate 8, the two ends of the scraper plate 8 are inserted into the inclined grooves 27, a space along the thickness direction of the scraper plate is formed between the scraper plate 8 and the inclined grooves 27 to move the flat mop head back and forth, the wiper 5 is in contact with the scraper plate 8 to drive the scraper plate 8 to rotate in the inclined grooves 27, so that the scraper plate 8 has a certain rotation angle, and then the effect of adjusting the size of the squeeze opening is achieved. Due to the limitation of the inclined grooves 27, the scraper plate 8 can only move to a certain extent, thus reaching the narrow position and the maximum squeeze opening position.

Alternatively, the two ends of the scraper plate are provided with inclined grooves, the squeezing frame is provided with insert plates corresponding to the two inclined grooves, the insert plates are inserted into the inclined grooves, and a space along the thickness direction of the scraper plate is arranged between the insert plates and the inclined grooves; and by pushing and pulling a squeeze handle, the wiper makes contact with the scraper plate, and the scraper plate is driven to rotate, so that the scraper plate has a certain rotation angle, and the effect of adjusting the size of the squeeze opening is achieved. Due to the cooperative limitation of the inclined grooves and the insert plates, the scraper plate can only move to a certain extent, thus reaching the narrow position and the maximum squeeze opening position.

Figure 6:
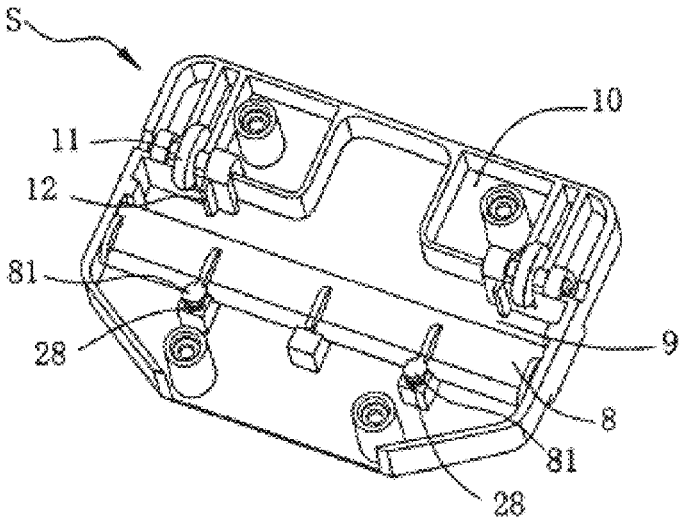
FIG. 6 is a structural diagram showing a scraper plate being in a narrow position through a first elastic device in an embodiment of the present invention.
Figure 7:
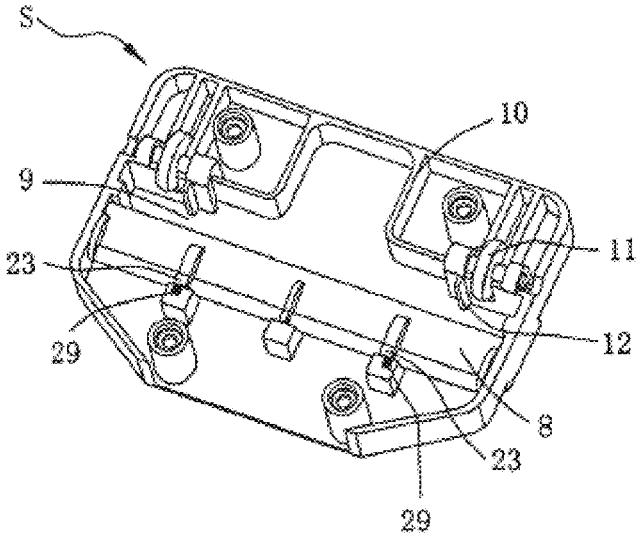
FIG. 7 is a structural diagram showing a scraper plate being in a narrow position through a second elastic device in an embodiment of the present invention.
Figure 8:
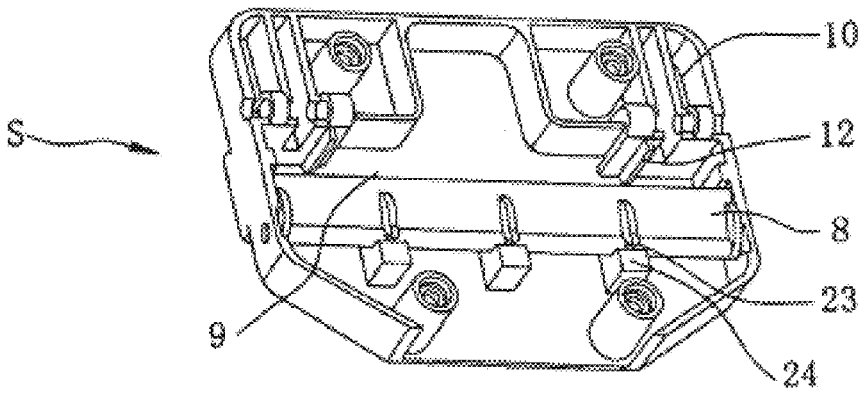
FIG. 8 is a structural diagram of a first squeeze device of the present invention.
Figure 9:
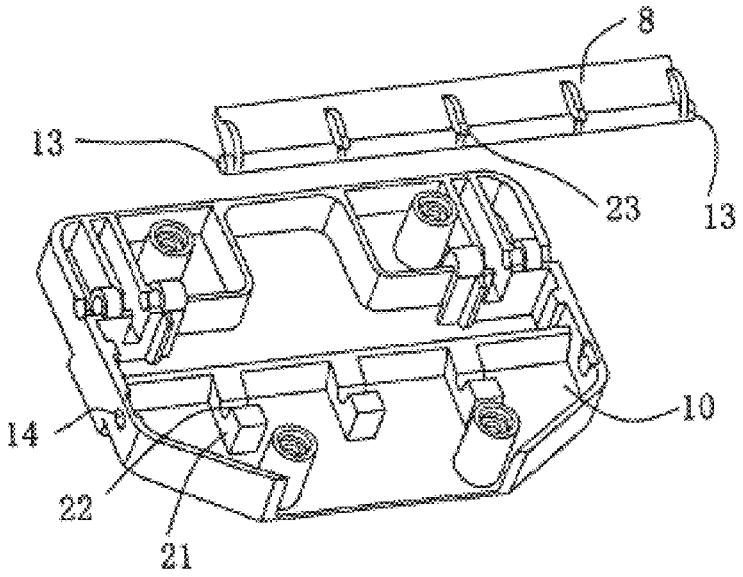
FIG. 9 is an exploded view of FIG. 8.
Figure 10:
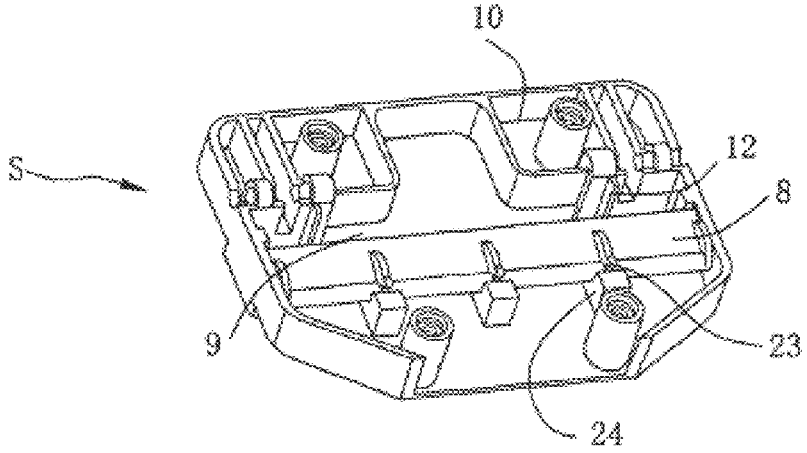
FIG. 10 is a structural diagram of a second squeeze device of the present invention.
Figure 11:
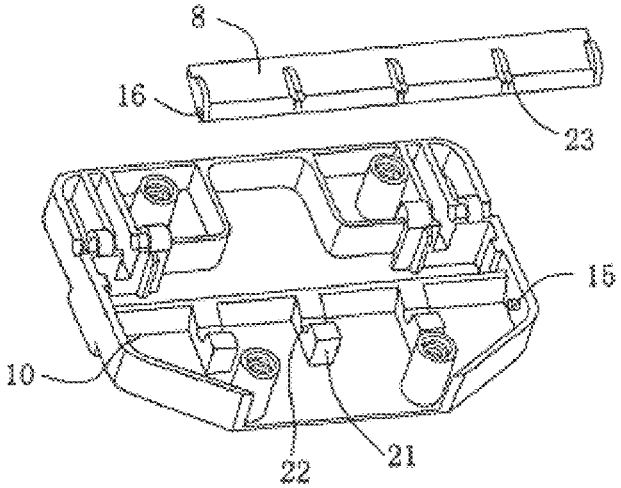
FIG. 11 is an exploded view of FIG. 10.

In the previous embodiment, the scraper plate reaches the narrow position by the wiper 5 naturally driving the scraper plate 8 to rotate. The scraper plate 8 can reach the narrow position by other means, for example, FIG. 6 and FIG. 7 show two different forms of elastic devices in the squeezing frame 10 respectively. The elastic device acts on the scraper plate 8 to place the scraper plate in the narrow position, so as to make the squeeze opening small; in this case, the scraper plate 8 is already in the narrow position in the initial state, so there is no need to press the flat mop head 4 downwards to make the wiper 5 drive the scraper plate 8 to rotate to the narrow position. When the flat mop head 4 is pulled upwards, the frictional squeezing force between the wiper 5 and the scraper plate 8 overcomes the elastic force of the elastic device to rotate the scraper plate 8 upwards, thereby enlarging the squeeze opening. The method can also achieve an efficient squeezing effect, and the operation of pulling up the flat mop is also very easy. FIG. 6 shows a specific structure of the first elastic device, the elastic device is a compression spring 28 limited in the squeezing frame 10, one end of the compression spring 28 abuts against the squeezing frame 10, and the other end abuts against an abutting end 81 extending from the scraper plate 8, so that the scraper plate 8 has a tendency to rotate to the narrow position. FIG. 7 shows a specific structure of the second elastic device, the elastic device is a torsion spring 29 limited in the squeezing frame 10, one end of the torsion spring 29 abuts against the squeezing frame 10, and the other end abuts against the lug 23 extending from the scraper plate 8, so that the scraper plate 8 has a tendency to rotate to the narrow position.

In this embodiment, a guide surface 30 for guiding the insertion of the flat mop head 4 is provided at the periphery of an opening of the squeezing frame 10. When the flat mop head 4 is inserted into the squeeze opening 9, the flat mop head 4 can be more conveniently inserted through the guide of the guide surface 30. The guide surface 30 is generally provided as a downward inclined slope. Another function of the guide surface 30 is that water squeezed out will not spill out of the mop bucket 1 due to the function of the guide surface 30, see FIG. 1.

In the aforementioned seven kinds of squeeze devices S, the scraper plate 8 is mounted on the squeezing frame 10, and the squeezing frame 10 is provided with the opening. FIG. 27-FIG. 31 show the eighth to twelfth squeeze devices, in which the squeezing frame 10 does not have an opening, the squeezing frame 10 of the squeeze device S only provides the installation of the scraper plate 8, the scraper plate 8 is installed on the squeezing frame 10, at the same time, the inner wall of the mop bucket 1 is provided with the support member, and the support member is opposite the scraper plate 8, thus forming the squeeze opening 9 between the scraper plate 8 and the support member.

Figure 27:
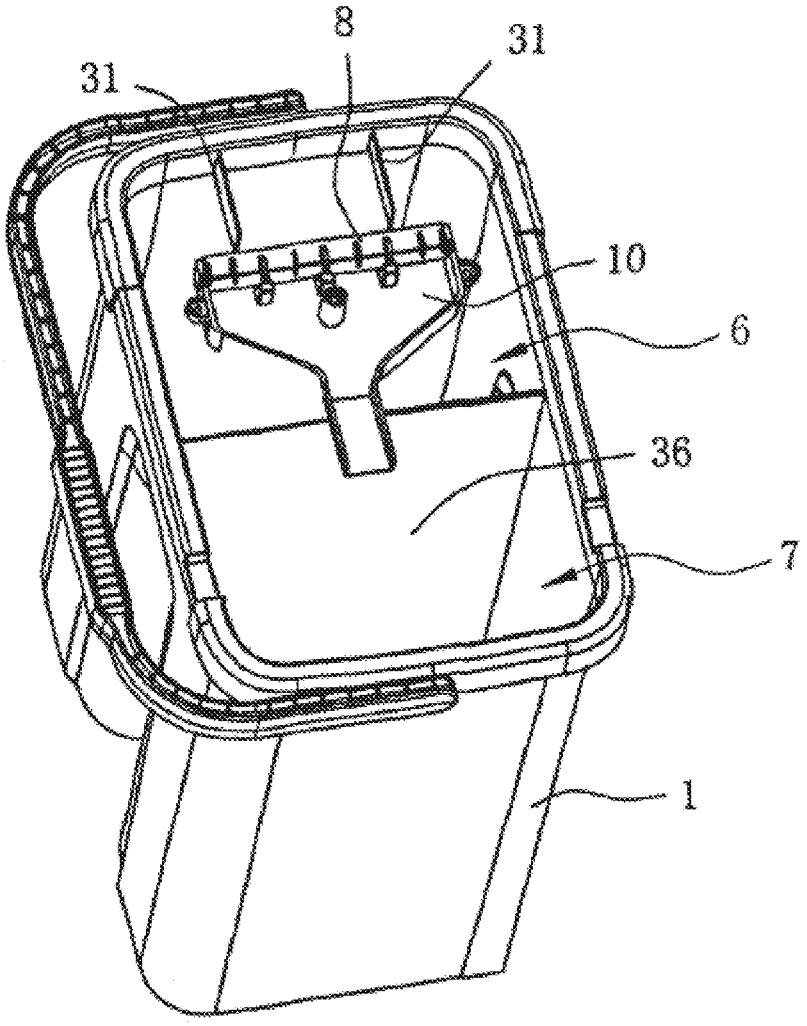
FIG. 27 is a structural diagram showing an eighth squeeze device of the present invention being installed on a mop bucket.
Figure 28:
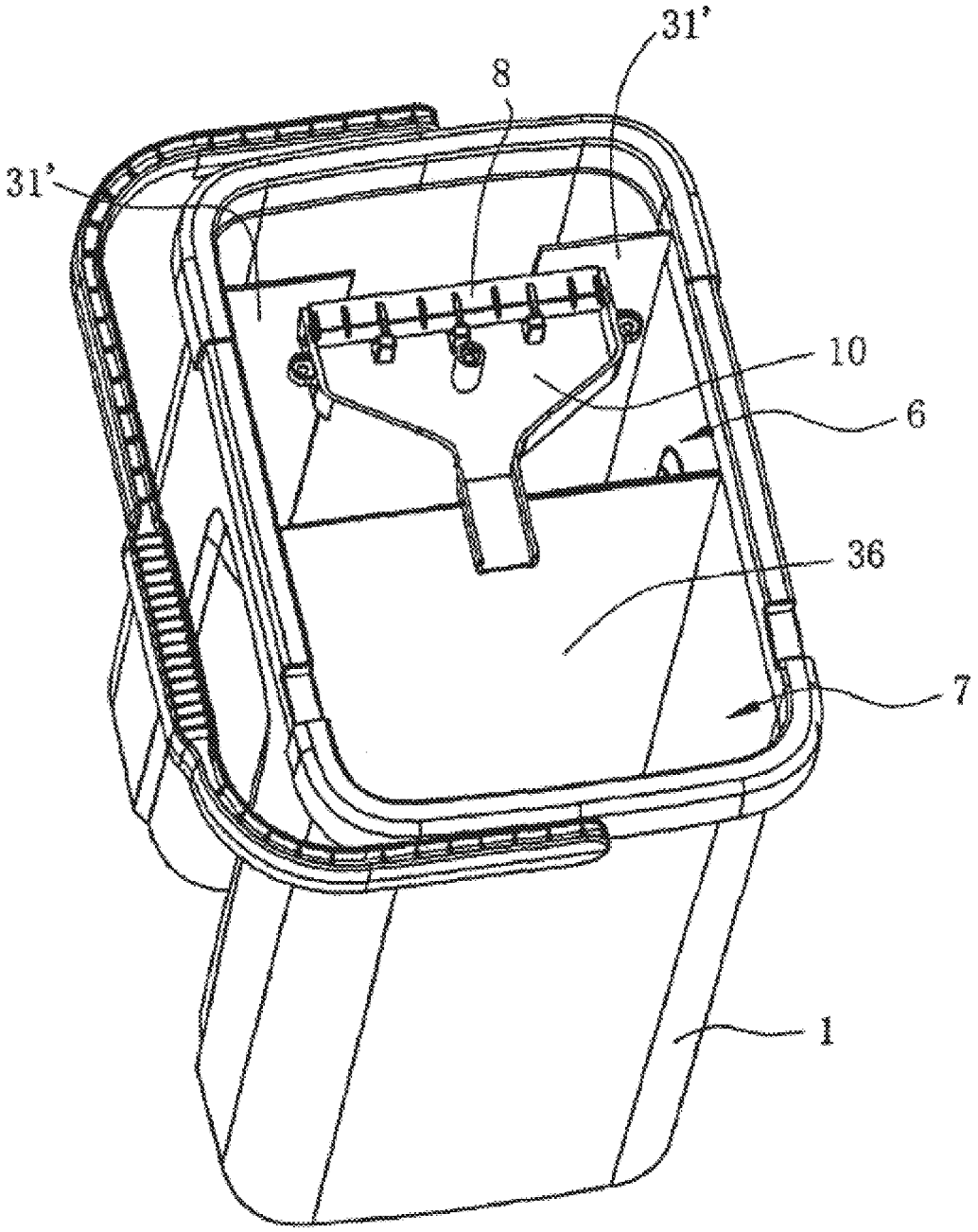
FIG. 28 is a structural diagram showing a ninth squeeze device of the present invention being installed on a mop bucket.
Figure 29:
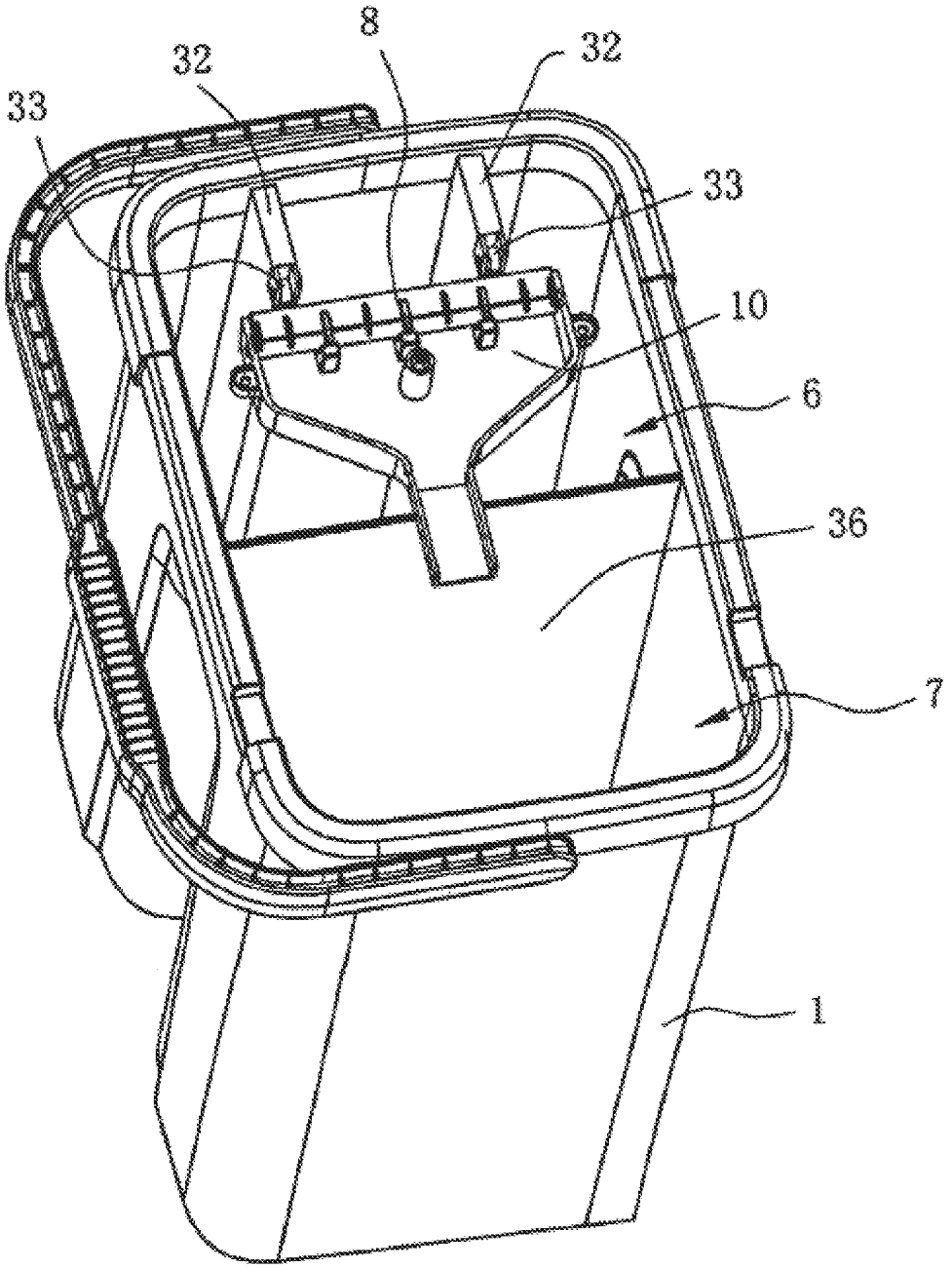
FIG. 29 is a structural diagram showing a tenth squeeze device of the present invention being installed on a mop bucket.
Figure 30:
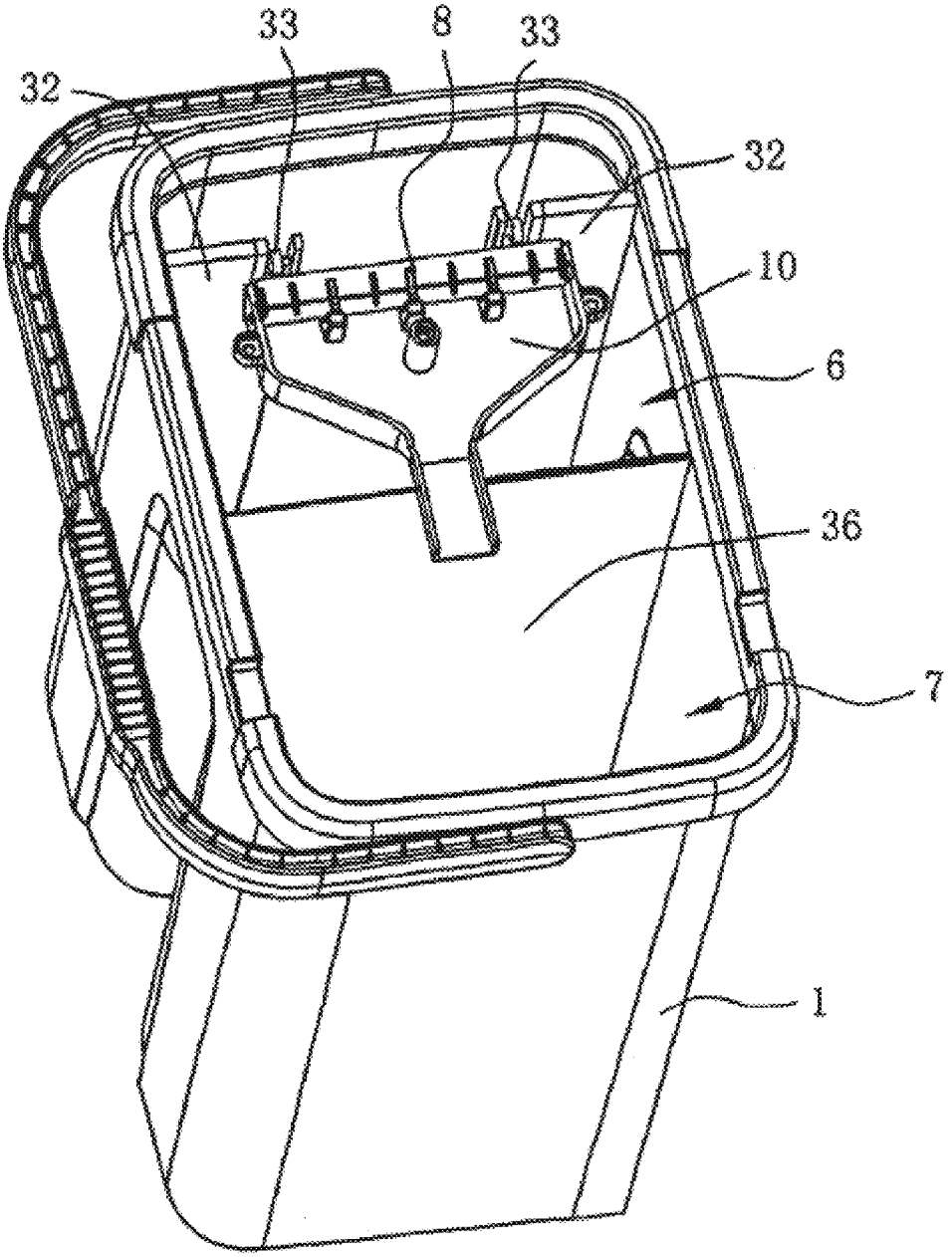
FIG. 30 is a structural diagram showing an eleventh squeeze device of the present invention being installed on a mop bucket.
Figure 31:
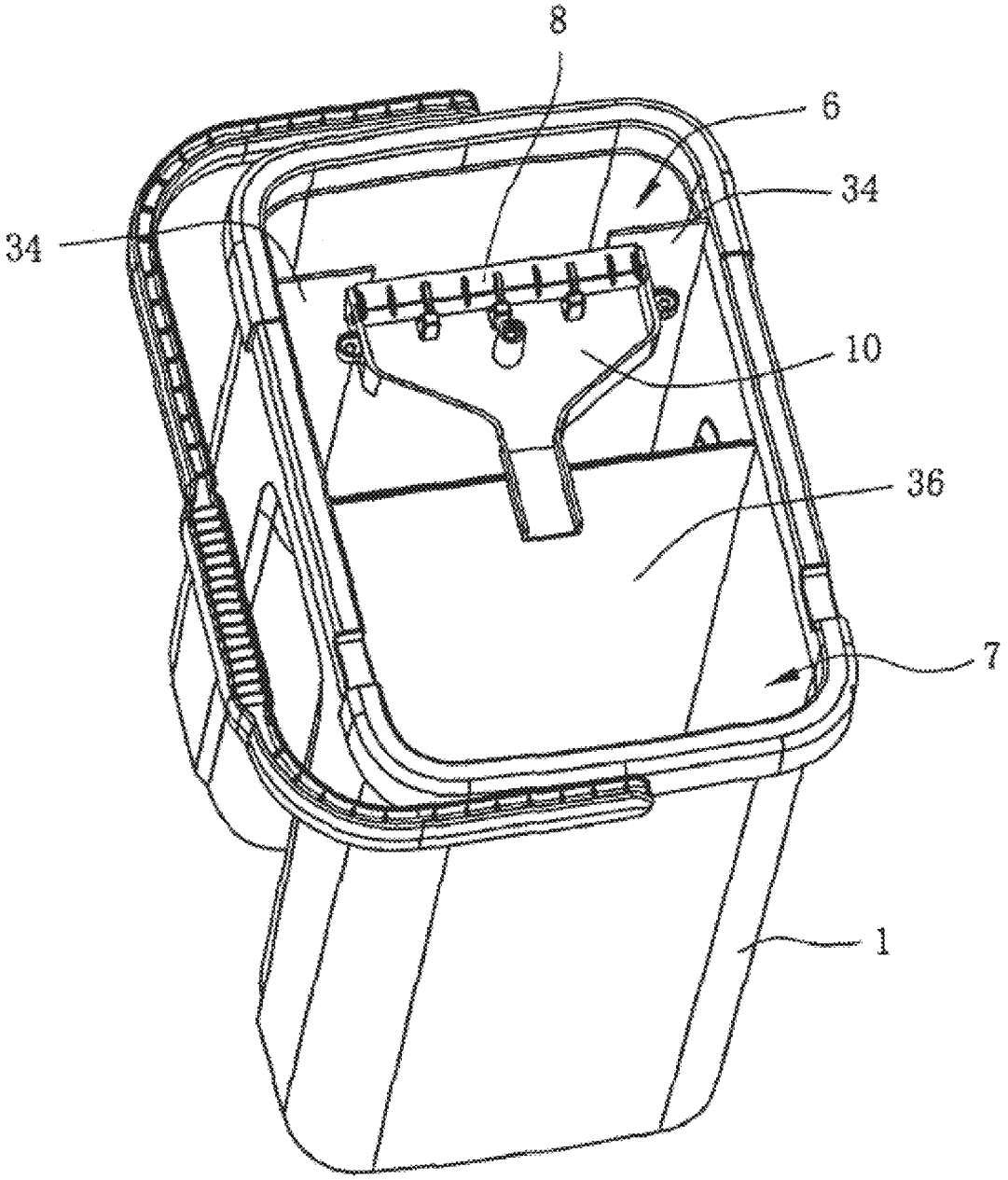
FIG. 31 is a structural diagram showing a twelfth squeeze device of the present invention being installed on a mop bucket.

In the eighth squeeze device shown in FIG. 27, the support member is a support plate 31, and the support plate 31 is arranged on an end face, opposite the scraper plate, of the mop bucket 1. In the ninth squeeze device shown in FIG. 28, the support member is a support plate 31', and the support plate 31' is arranged on a side surface of the mop bucket 1 and extends transversely. In the tenth squeeze device shown in FIG. 29, the support member is a support frame 32 arranged on an end face, opposite the scraper plate 8, of the mop bucket 1, and a tail end of the support frame 32 is provided with a roller 33. In the eleventh squeeze device shown in FIG. 30, the support member is a support frame 32 provided on a side surface of the mop bucket 1, and a tail end of the support frame is provided with a roller 33. In the twelfth squeeze device shown in FIG. 31, the support member is a transversely extending guide plate 34 provided on a side surface of the mop bucket 1, guide grooves are provided on both sides of the flat mop head 4, and the guide plate 34 is inserted into the guide grooves during cleaning or squeezing.

In a thirteenth squeeze device shown in FIG. 32, the squeeze device S does not comprise a squeezing frame, and the scraper plate 8 is directly installed on the mop bucket 1; specifically, the two ends of the scraper plate 8 are provided with shaft posts 82 which directly penetrate into the mop bucket 1, or the same rotational connection mode as that described in the previous embodiment is adopted, except that a rotational connection structure is arranged on the mop bucket. At this point, when the flat mop head 4 is pressed downwards, the effect that the scraper plate 8 is positioned in a narrow position relative to the support member and the scraper plate 8 is in the maximum squeeze opening position can be realized by a limiting device, a specific structure of the limiting device can be referred to the description of the previous embodiment, and the difference lies in that the limiting device in the first to seventh squeeze devices is installed on the squeezing frame 10, while in the thirteenth squeeze device shown in FIG. 32, the limiting device is installed on the mop bucket 1. It should be noted that the mop bucket shown in FIG. 27-FIG. 32 only shows the case where the squeezing area 6 is provided with the squeeze device S, and the specific arrangement of the squeeze device in the cleaning area 7 is the same as that in the squeezing area, that is, the realization of the squeeze opening in the cleaning area and the squeeze opening 9 in the squeezing area may be the same, which is omitted from the figures.

In this embodiment, the bottom of the mop bucket in the squeezing area and/or the cleaning area is provided with convex bosses, and the convex bosses extend away from the scraper plate 8 and the extending length at least exceeds the squeeze opening 9. The significance of the convex bosses is to prevent the flat mop head 4 from being inserted too much when inserting the flat mop head 4 into the squeeze device, which may cause the flat mop head 4 to pass over the squeeze opening 9 and fall below the squeeze device, leading to the failure in pulling back the flat mop head. After the bosses are arranged, the bosses limit a pressing limit position of the flat mop head 4, and the flat mop head 4 cannot be pressed down any more after touching the bosses, thus avoiding the above phenomenon. In addition, the convex bosses need to have a large extension length, which at least exceeds the squeeze opening 9, so as to prevent the flat mop head 4 from being out of control due to inclination by a certain length in the pressing process.

In the thirteenth squeeze device shown in FIG. 32, the mop bucket is internally provided with a partition board 36, and the partition board 36 divides the mop bucket into an independent squeezing area 6 and an independent cleaning area 7. The partition board 36 may be integrally formed with the mop bucket. Of course, the independent cleaning area and the independent squeezing area can also be formed in other ways, for example, an independent squeezing cylinder and an independent cleaning cylinder are arranged, and then the squeezing cylinder and the cleaning cylinder are connected.

What is claimed is:

1. A tool for cleaning squeeze flat mop having an adjustable squeeze opening, and comprising a mop bucket and a flat mop, wherein the flat mop comprises a mop stick and a flat mop head movably connected to the mop stick, and a wiper is provided on the flat mop head;

the mop bucket has a squeezing area, a squeeze device is mounted on the mop bucket, and during squeezing, the flat mop head is rotated to a state suitable for squeezing;

the squeeze device comprises a scraper plate used for squeezing the wiper on the flat mop head, and a support member opposite the scraper plate, and the squeeze opening is formed between the scraper plate and the support member;

wherein during squeezing, the flat mop head is inserted into the squeeze opening in the squeezing area, the scraper plate touches the wiper, and the wiper and the scraper plate are moved and squeezed relative to each other, so as to squeeze the wiper to scrape off water from the wiper; and the scraper plate is rotatably provided on the mop bucket, and a size of the squeeze opening can be changed by a rotation of the scraper plate;

when the flat mop head is pressed downwards, the wiper drives the scraper plate to rotate downwards, so that the scraper plate is positioned in a narrow position relative to the support member, thereby reducing the squeeze opening, and enlarging a friction force to the wiper to facilitate squeezing and scraping the wiper; and when the flat mop head is pulled upwards, the wiper drives the scraper plate to rotate upwards, thereby enlarging the squeeze opening, to reduce a friction force between the scraper plate and the wiper, and to prevent the mop bucket from being lifted up when the flat mop head is lifted upwards, and the scraper plate still squeezes the wiper when the flat mop head is lifted upwards even though the friction force is reduced.

2. The tool of claim 1, wherein the support member is another scraper plate or other support member.

3. The tool of claim 1, wherein the scraper plate is directly installed on the mop bucket.

4. The tool of claim 3, wherein two ends of the scraper plate are provided with rotating pins respectively, and the two rotating pins are inserted into the mop bucket;

alternatively, the mop bucket is provided with convex shafts, and the convex shafts are inserted into the two ends of the scraper plate respectively.

5. The tool of claim 3, wherein the mop bucket is provided with a pivoting base, and a side edge of the scraper plate is pivoted to the pivoting base.

6. The tool of claim 3, wherein the mop bucket is provided with a clamping base, the clamping base is provided with a clamping opening, the scraper plate is provided with a clamped shaft, and the clamped shaft rotates after being clamped into the clamping opening of the clamping base.

7. The tool of claim 3, wherein the mop bucket is provided with a limiting device, and when the flat mop head is pressed downwards, the rotation of the scraper plate can be limited by the limiting device, so that the squeeze opening is kept small.

8. The tool of claim 7, wherein the limiting device comprises limiting bases arranged on the mop bucket, the limiting bases are provided with limiting notches, the scraper plate is positioned in the limiting notches, and the scraper plate reaches the narrow position when touching a side of the limiting bases.

9. The tool of claim 7, wherein the limiting device comprises two limiting grooves formed in the mop bucket, two ends of the scraper plate are inserted into the limiting grooves, and the scraper plate reaches the narrow position when touching a side of the limiting grooves.

10. The tool of claim 7, wherein the mop bucket is provided with a blocking part for blocking the scraper plate, and the scraper plate reaches the narrow position when touching the blocking part.

11. The tool of claim 7, wherein the limiting device can also limit the scraper plate to a maximum squeeze opening position when the squeeze opening is enlarged, and when the flat mop head moves upwards, the rotation of the scraper plate can be limited by the limiting device, so that the squeeze opening is kept large.

12. The tool of claim 1, wherein the scraper plate is installed on a squeezing frame, and the squeezing frame is installed on the mop bucket.

13. The tool of claim 12, wherein two ends of the scraper plate are provided with rotating pins respectively, and the two rotating pins are inserted into shaft holes in the squeezing frame so that the scraper plate rotates about a rotational axis extending along the two rotating pins.

14. The tool of claim 12, wherein the squeezing frame is provided with a pivoting base, and a side edge of the scraper plate is pivoted to the pivoting base.

15. The tool of claim 12, wherein the squeezing frame is provided with a clamping base, the clamping base is provided with a clamping opening, the scraper plate is provided with a clamped shaft, and the clamped shaft rotates after being clamped into the clamping opening of the clamping base.

16. The tool of claim 12, wherein the squeezing frame is provided with a limiting device, and when the flat mop head is pressed downwards, the rotation of the scraper plate can be limited by the limiting device, so that the squeeze opening is kept small.

17. The tool of claim 16, wherein the limiting device comprises limiting bases arranged on the squeezing frame, the limiting bases are provided with limiting notches, the scraper plate is positioned in the limiting notches, and the scraper plate reaches the narrow position when touching a side of the limiting bases.

18. The tool of claim 16, wherein the limiting device comprises two limiting grooves formed in the squeezing frame, two ends of the scraper plate are inserted into the limiting grooves, and the scraper plate reaches the narrow position when touching a side of the limiting grooves.

19. The tool of claim 16, wherein the squeezing frame is provided with a blocking part for blocking the scraper plate, and the scraper plate reaches the narrow position when touching the blocking part; and further comprising an elastic device that is a torsion spring that abuts against the squeezing frame to bias the squeezing frame.

20. The tool of claim 12, wherein the squeezing frame is provided with inclined grooves corresponding to two ends of the scraper plate, the two ends of the scraper plate are inserted into the inclined grooves, a space along a thickness direction of the scraper plate is formed between the scraper plate and the inclined grooves, and a width of the squeeze opening can be adjusted during movement of the scraper plate;

alternatively, two ends of the scraper plate are provided with inclined grooves, the squeezing frame is provided with insert plates corresponding to the two inclined grooves, the insert plates are inserted into the inclined grooves, a space along a thickness direction of the scraper plate is formed between the insert plates and the inclined grooves, and a width of the squeeze opening can be adjusted during movement of the scraper plate.

21. The tool of claim 1, further comprising an elastic device which acts on the scraper plate to place the scraper plate in the narrow position so as to make the squeeze opening relatively small.

22. The tool of claim 1, wherein the mop bucket is provided with inclined grooves corresponding to two ends of the scraper plate, the two ends of the scraper plate are inserted into the inclined grooves, a space along a thickness direction of the scraper plate is formed between the scraper plate and the inclined grooves, and a width of the squeeze opening can be adjusted during movement of the scraper plate;

alternatively, two ends of the scraper plate are provided with inclined grooves, the mop bucket is provided with insert plates corresponding to the two inclined grooves, the insert plates are inserted into the inclined grooves, a space along a thickness direction of the scraper plate is formed between the insert plates and the inclined grooves, and a width of the squeeze opening can be adjusted during movement of the scraper plate.

23. The tool of claim 1, wherein the mop bucket has a cleaning area, during cleaning, the flat mop head is rotated to a state suitable for cleaning, the flat mop head is inserted into the squeeze opening in the cleaning area, and the wiper and the scraper plate are moved and squeezed relative to each other so as to clean the wiper.

* * * * *